US007059494B2

(12) United States Patent
Harrelson et al.

(10) Patent No.: US 7,059,494 B2
(45) Date of Patent: Jun. 13, 2006

(54) CARTON WITH AN IMPROVED DISPENSING FEATURE

(76) Inventors: Glenn R. Harrelson, 9315 Spinnaker La., Gainesville, GA (US) 30506; Raymond Rudolph Spivey, 475 Ivey Ct., Mableton, GA (US) 30216; Ronald J. Hammond, 5138 Bevington Pl., Charlotte, NC (US) 28277-5505

( * ) Notice: Subject to any disclaimer, the term of this patent is extended or adjusted under 35 U.S.C. 154(b) by 195 days.

(21) Appl. No.: 10/202,106

(22) Filed: Jul. 24, 2002

(65) Prior Publication Data

US 2002/0185499 A1 Dec. 12, 2002

Related U.S. Application Data

(63) Continuation-in-part of application No. 09/757,714, filed on Jan. 9, 2001, now Pat. No. 6,578,736.

(51) Int. Cl.
*B65G 59/00* (2006.01)
*A47F 1/04* (2006.01)
*G07F 11/16* (2006.01)

(52) U.S. Cl. ..... 221/92; 221/302; 221/305; 221/306

(58) Field of Classification Search ..... 221/92, 221/124, 302, 305, 306, 312 R, 312 C; 206/738, 206/745, 746, 147; 229/120.01, 120.011, 229/120.03
See application file for complete search history.

(56) References Cited

U.S. PATENT DOCUMENTS 1,541,143 A 6/1925 Hoile
1,698,699 A 1/1929 Andrews
1,925,102 A 9/1933 Levkoff ..... 206/44
2,448,819 A 9/1948 Mitchell ..... 206/57
2,718,301 A 9/1955 Palmer
2,723,027 A 11/1955 Guyer
2,842,304 A 7/1958 Ringler
2,930,516 A 3/1960 Fowle et al.
2,975,891 A 3/1961 Stone
3,002,651 A 10/1961 Gauld ..... 221/34
3,113,673 A * 12/1963 Stein ..... 229/120.011
3,127,991 A * 4/1964 Burnett ..... 206/499

(Continued)

FOREIGN PATENT DOCUMENTS

CA 874828 7/1971

(Continued)

*Primary Examiner*—David H. Bollinger
(74) *Attorney, Agent, or Firm*—Kennedy Covington Lobdell & Hickman, LLP

(57) ABSTRACT

A multicarton pack which can be easily separated into individual cartons, without destroying the integrity of any of the cartons in the pack. Cartons may have an improved dispenser at one end of the carton, which preserves the integrity of the carton when the carton is opened by permitting a bottom end flap attached to the bottom panel to remain in place and also a portion of each side end flap that is adjacent to the bottom end flap. The dispenser may also provide a safety net for the first container that is automatically dispensed when the carton is opened. This is achieved by a novel method of providing a pattern of cuts in adjoining side walls of the cartons and for the cartons to be glued together by gluing the cuts on one of the adjoining side walls. The location of glue spots and their size and number are sufficient to maintain the pack together but yet allow the cartons to be separated without destroying the integrity of the panels glued together.

9 Claims, 8 Drawing Sheets

U.S. PATENT DOCUMENTS 3,135,457 A 6/1964 Risucci ..... 229/51
3,178,242 A 4/1965 Ellis et al. ..... 312/45
3,228,582 A 1/1966 Osberg ..... 229/51
3,246,796 A 4/1966 Englander et al. ..... 220/15
3,263,861 A 8/1966 Carr
3,265,283 A 8/1966 Farquhar ..... 229/7
RE26,083 E 9/1966 Forrer
3,300,115 A 1/1967 Schauer
3,356,279 A 12/1967 Root
3,367,556 A 2/1968 Whitby ..... 229/32
3,447,733 A * 6/1969 Nelson et al. ..... 229/120.011
3,517,858 A 6/1970 Farquhar
3,540,581 A 11/1970 Koolnis
3,568,910 A 3/1971 McConnell ..... 229/17
3,669,251 A 6/1972 Phillips, jr. ..... 206/44 R
3,677,458 A 7/1972 Cosling ..... 229/27
3,765,527 A 10/1973 Vargo
3,894,681 A 7/1975 Arneson et al.
3,912,157 A 10/1975 Graser
3,913,739 A 10/1975 Hennessey ..... 206/434
4,000,811 A 1/1977 Hardison et al.
4,030,596 A 6/1977 Synder et al.
4,042,168 A 8/1977 Kasel et al. ..... 229/40
4,214,660 A 7/1980 Hunt, Jr.
4,222,485 A 9/1980 Focke
4,263,769 A 4/1981 Hanazawa et al.
4,364,509 A 12/1982 Holley, Jr. et al. ..... 229/17
4,365,710 A 12/1982 Swanson ..... 206/386
4,375,258 A 3/1983 Crayne et al.
4,396,143 A 8/1983 Killy
4,416,410 A 11/1983 Hermann ..... 229/38
4,417,661 A 11/1983 Roccaforte
4,518,115 A 5/1985 Sedwick ..... 229/52
4,582,199 A 4/1986 Schuster ..... 206/428
4,684,058 A 8/1987 Weber ..... 229/17
4,726,471 A 2/1988 Whately et al.
4,913,291 A 4/1990 Schuster ..... 206/602
4,919,266 A 4/1990 McIntosh, Jr. et al.
4,974,771 A 12/1990 Lavery
5,123,589 A 6/1992 Cote
5,137,211 A 8/1992 Summer et al.
5,161,732 A 11/1992 Clein et al. ..... 229/117
5,170,934 A 12/1992 Lemoine
5,174,444 A 12/1992 Adams et al. ..... 206/256
5,178,268 A 1/1993 Talley et al.
5,269,645 A 12/1993 Winski ..... 414/786
5,279,440 A 1/1994 Fougeres et al.
5,368,194 A * 11/1994 Oliff et al. ..... 221/305
5,427,242 A 6/1995 Oliff et al.
5,465,831 A 11/1995 Smith ..... 206/44 R
5,495,703 A 3/1996 Kruit et al.
5,622,309 A 4/1997 Matsuda et al.
5,647,191 A 7/1997 Villemure ..... 53/447
5,722,584 A 3/1998 Fujiwara
5,775,574 A 7/1998 Whitnell
5,788,117 A 8/1998 Zimmanck ..... 221/285
5,855,316 A 1/1999 Spivey ..... 229/120.14
5,878,947 A 3/1999 Hoy et al.
5,895,540 A 4/1999 David et al. ..... 156/226
6,105,854 A 8/2000 Spivey et al.
6,176,419 B1 1/2001 Holley, Jr.
6,283,293 B1 9/2001 Lingamfelter ..... 206/427
6,405,913 B1 6/2002 Passamoni ..... 225/43
6,578,736 B1 6/2003 Spivey
2002/0070139 A1 6/2002 Bates
2002/0185499 A1 12/2002 Harrelson et al.
2003/0192907 A1 * 10/2003 Bates ..... 221/305

FOREIGN PATENT DOCUMENTS

CA 2246020 2/2000
DE 7510538 8/1975
DE 8514718.4 6/1985
DE 36 12 594 A1 10/1987
EP 0 849 189 A1 6/1998
GB 2186550 8/1987
JP 7-9721 2/1995
WO WO 96/29260 9/1996
WO WO 97/21607 6/1997

* cited by examiner

FIG A

CARTON WITH AN IMPROVED DISPENSING FEATURE

CROSS-REFERENCE TO RELATED APPLICATION

This application is a continuation-in-part of U.S. utility application entitled, "CARTON WITH AN IMPROVED DISPENSING FEATURE," having Ser. No. 09/757,714, filed Jan. 9, 2001 now U.S. Pat. No. 6,578,736, of which Raymond Spivey is the inventor, which is entirely incorporated herein by reference.

TECHNICAL FIELD

The present invention relates generally to a multipack of cartons capable of enclosing containers and joined together by making a pattern of cuts in the paperboard panels to be glued together to permit the multipack to maintain its integrity and to facilitate the cartons being separated from each other. This multipack may also have a dispenser that allows the containers, for example, cans or bottles, to be removed or dispensed without destroying the overall structural integrity of the carton. A basket for the first container that is automatically dispensed when the carton is opened may also be provided. The dispensing feature also permits the carton to be carried from one location to another after the dispenser has been opened without the containers falling out of the carton.

BACKGROUND OF THE INVENTION

Fully enclosed cartons capable of enclosing cans have been used in the past that have a feature for dispensing the cans one at a time. Dispenser sections have been provided at various locations within these cartons depending on the design. Many of these dispensers suffer from the disadvantage that once open, they allow all of the containers to roll out. In addition, it is difficult to carry one of these cartons without the containers falling out once the dispenser has been opened. Most of these dispensers have been designed for dispensing cans or bottles which have cylindrical tops and bottoms of substantially the same size and configuration. These dispensers are not suitable for dispensing bottles that have a neck of smaller diameter than the body of the bottle.

In effect, many of these dispensers destroy the overall carton integrity once they have been opened. Many of these dispensing features do not have any means for preventing the first container that is automatically dispensed from falling free from the carton. In other words, its dispensing feature has no safety net.

Satisfactory multiple carton packages that contain different types of beverages in the pack have not been developed. Satisfactory methods of gluing the cartons together into a multipack have not been developed that would facilitate the easy separation of the cartons by the consumer.

PRIOR ART

Sometimes beverage manufacturers desire a package in which there are two rows of containers or where the package can be separated into two different cartons.

One of these cartons is disclosed in U.S. Pat. No. 4,913,291 issued on Apr. 3, 1990 to Richard L. Schuster. This carton is formed from a single sheet of paperboard and can be divided into two cartons by breaking weakened fold lines in areas of the carton.

U.S. Pat. No. 3,246,796 to Robert A. Englander, which issued on Apr. 19, 1966, discloses a carton that is made from a single sheet of paperboard and can be divided into two or four separate cartons. The carton has a handle with two plys of paperboard that may be stapled or glued together. The carton has two partition panels 24 which are held together at the bottom with tabs and slots 74, 76 as shown in FIG. 1.

U.S. Pat. No. 3,677,458, which issued on Jul. 18, 1972 (Gosling), discloses an end-loading twin carton that can be separated into two cartons. The two cartons are basically formed from a single sheet of paperboard with adjoining vertical panels which can be separated into two cartons by pulling a tab 29 on tear strip 28 as shown in FIG. 1. Because the cartons are not joined at the bottom, the twin packs may be somewhat unstable or wobbly when being carried. U.S. Pat. No. 5,855,316, which issued on Jan. 5, 1999 (Spivey), discloses a basket carrier composed of two identical carrier units connected together by gluing the handle plys together to form a centrally located handle panel for the carrier. These two basket units are not designed to be separated from each other.

Cartons for carrying beverage containers in two or more tiers with a dispenser for each tier are disclosed in U.S. Pat. No. 5,368,194, issued on Nov. 29, 1994 (Oliff et al.). The carton may have a divider insert 90 between two tiers as illustrated in FIG. 5.

U.S. Pat. No. 3,135,457, issued on Jun. 2, 1964 (Risucci), discloses a carton that can be separated into two separate units. The units are attached by an accordion flap 13 between the left and right front panels 11 and 12 and which has a tear strip for separating this into two units. The two units are not otherwise attached to each other. This may be unstable or wobbly while carrying. A similar carton, which may be divided into two units, is disclosed in British Specification No. 739,899, published on Aug. 3, 1954. The carton is separated into two units by line 3, between panels 1 and 2, as shown in FIG. 1. The two units are otherwise not attached, which makes them somewhat unstable during carrying.

U.S. Pat. No. 5,174,444, which issued on Dec. 29, 1992 (Adams et al.), discloses a label 40 holding two cigarette cartons together, which can be separated by tearing along a perforated line 41 as shown in FIG. 2. Tab 42 is used to join the top of the cartons together and is easily removed and the perforated score line torn to separate into two cigarette cartons.

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by an arcuate flap portion extending downwardly in the end wall into the center of the aperture. The structural integrity of this carton is compromised because the entire bottom end of the carton is opened. The dispensing flap does not provide a safety net to prevent a can from rolling out of the carton and falling to the floor. This carton cannot be easily moved from one location to another after the dispenser has been opened without the containers falling out. It will be realized that the design of this carton is not satisfactory for dispensing bottles with necks as the exiting container being dispensed needs to have a corresponding cylindrical top and bottom of approximately the same size to facilitate easy dispensing by a person grasping the ends of the exiting container.

U.S. Pat. No. 4,364,509 to Holley, Jr. et al. also discloses a fully enclosed carton with a dispenser in one end of the end walls. This dispenser is likewise formed in the end wall by tearing out an end flap and lowering it into proper position. Expansion slits are provided in the side wall for the user's fingers to grasp the ends of the exiting can. This carton is not adapted for use with bottles, because of the necessity of grasping the ends of the container for removal. In addition, it is not adapted for carrying cans once the carton has been opened as they are likely to roll out of the dispenser. There is also no safety net to receive the cans as they are rolled out of the dispenser.

U.S. Pat. No. 6,283,293 to Lingamfelter discloses a twelve-pack carton of cans with four cans in each row. A dispenser (FIG. 1) is formed in the top portion of the end wall. The carton is designed to fit on a refrigerator shelf as illustrated in FIG. 1, where the top tier of cans can be removed through the dispenser. It is difficult to remove the bottom row and middle row because the front wall f/w has a height more than the diameter of one can, but less than the diameter of two cans, preferably between 1.5 and 1.8 times the diameter of a can. Col. 2, line 67 to Col. 3, line 3. Consequently, this carton does not provide a satisfactory dispenser because of the difficulty of removing cans from the bottom of the carton.

Thus, a heretofore unaddressed need exists in the industry to address the aforementioned deficiencies and inadequacies.

SUMMARY OF THE INVENTION

It is an object of this invention to provide a dispenser that preserves the integrity of the carton after the dispenser has been opened. It is a further object to provide a dispenser that can be used with both cans and bottles. It is another object of this invention to provide a safety net or basket for the containers that are automatically dispensed when the dispenser is opened. It is a still further object of this invention to develop a dispenser that will permit the carton to be moved from one location to another after it has been opened without discharging containers. Another object of this invention is to provide a dispenser that can be easily opened.

A further object of this invention is to provide a method of affixing multiple cartons together into a single package that can be easily carried, but yet allow the consumer to separate the individual cartons from each other. A further object is to provide such a multiple carton package with a dispenser for dispensing cans or bottles from the cartons. There is a still further object to provide a multicarton package that has a dispenser for each of the cartons.

Briefly described, in a preferred form, the objects of this invention are achieved by providing an enclosed carton that has a unique dispenser in the exiting end of the carton. This carton is generally rectangular and has a bottom, a top, two sides, a closed end and an exiting end. The carton is foldably constructed from a blank having panels and flaps. The exiting end or ends of the carton permits containers to be taken from the carton via the dispenser. The carton is preferably designed to carry two tiers of containers.

This carton has a dispenser that is torn from an end of the carton by tearing an end portion of the top panel, an triangular portion from the adjoining side panels, and all of the side end flaps except the bottom most portions, to form a dispenser. The top end flap is removed when this dispenser is opened. The bottom portions of the side end flaps are left intact to preserve the structural integrity of the carton and also to provide a wall to prevent an end container in the bottom of the carton from accidentally rolling out. Consequently, it is preferred that the height of the bottom portion of the side end flaps be left intact after the dispenser is removed and the bottom end flap on the exiting end of the carton be no greater than the diameter of the containers in the bottom row or tier.

It should be realized that the dispenser does not have to be totally removed from the carton, as the score lines in the side and top panels can be broken and the dispenser flipped over along the score lines in the side end flaps to form a safety net or basket when the first container in the top of the carton rolls out of the dispenser. If the score line in the side end flaps is not broken, the dispenser can be reclosed.

This carton can be constructed by gluing, taping, stapling and the like, or by locking. The dispenser of this invention can be put in one end of the carton or in both ends. A dispenser can be torn from the carton and placed under the other end of the carton to elevate it to facilitate the removal of the containers from the carton.

A multiple carton pack of this invention can be made by gluing together on cut lines that match cut lines of any adjoining carton, by providing the appropriate number of cut lines on each adjoining panel of the cartons. The matching cut lines on each adjoining panel of the carton pack can be glued to another carton, but yet the pack can be easily separated into individual cartons. The cartons in the multi-pack configuration may have dispensers and finger apertures to apply pressure to separate the cartons from each other. The cartons can be glued together in this way. The cartons may contain containers of different sizes.

These and other objects, features, and advantages of the present invention will become more apparent upon reading the following specification in conjunction with the accompanying drawing figures.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

The present invention is intended primarily for use with cans and bottles of the types used to contain soft drinks, beer and the like. The blank is formed from a foldable sheet material, such as paperboard. The cartons of the current invention are designed to be joined together to form a package of two, three or more individual cartons. The cartons of this invention are capable of containing cans or bottles in two rows or tiers, preferably six containers in each row. It is especially designed to put on a refrigerator shelf for dispensing the cans or bottles.

1. Twin Pack

Figure 1:
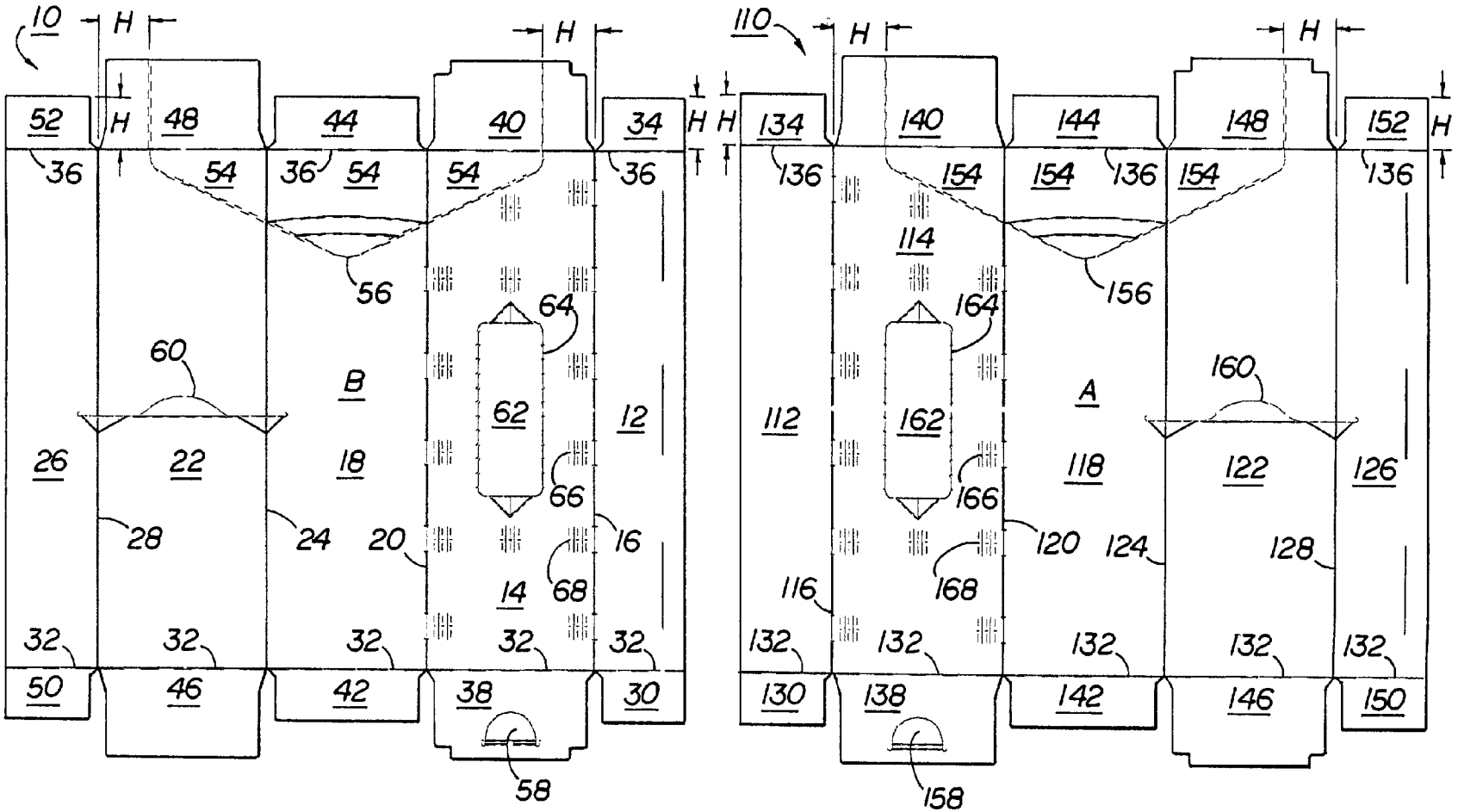
FIG. 1 is a plan view of blanks for forming cartons (A and B) for being glued together after being loaded with cans or bottles.

FIG. 1 is a plan view of carton blanks for forming both the right hand and left hand cartons of a twin pack. Carton A is the left-hand carton when viewed from the dispensing end. Carton B is the right hand carton when also viewed from the dispensing end.

In first looking at the blank 10 for carton B it has bottom flap 12 which is connected to an inside side panel 14 by fold line 16 and in turn connected to top panel 18 by fold line 20. Top panel 18 is connected to outside side panel 22 by fold line 24 and in turn connected to bottom flap 26 by fold line 28. Bottom flap 12 has bottom end flap 30 connected by fold line 32 and bottom end flap 34 connected to bottom panel 12 by fold line 36. Side end flap 38 is connected to inside side panel 14 by fold line 32 which is also connected to side end flap 40 by fold line 36. End flaps 42 and 44 are similarly connected to top panel 18. End flaps 46 and 48 are connected to side panel 22 and end flaps 50 and 52 are connected to bottom flap 26.

This carton preferably has a dispenser 54 that can be removed from the carton after it has been filled with cans by tearing tear line 56. It will be noted from FIGS. 1 and 7 that the bottom end flaps 34 and 52 and portions of the side end flaps 40 and 48 left intact after removal of the dispenser 54 preferably have a height (H) no greater than the diameter of the cans or bottles in the bottom row or tier. In any event, the height should not be significantly greater than the diameter of the containers. This is preferable to facilitate easy removal of the containers from the bottom of the carton, yet keep the bottom row of containers from rolling out. The height of portion of the side end flaps 40 and 48 left intact and the bottom end flaps 34 and 52 is ideally less than the diameter of the containers in the bottom row. It is only necessary that the height be sufficient to prevent the containers from rolling out of the carton. End flap 38 has a finger aperture 58 whose function will be described later. It may have a handle 60 on the outside side panel 22. One of the interesting features of this carton is that it may have a coupon 62 attached to or as part of the inside side panel 14 which can be easily removed by tearing tear line 64. The carton has a plurality of cut lines (e.g., 66 and 68) on the inside side panel whose function will be discussed later.

Carton A is a mirror image of carton B. Blank 110 has a bottom flap 112 which is connected to the inside side panel 114 by fold line 116 and in turn connected to top panel 118 by fold line 120. Top panel 118 is connected to outside side panel 122 by fold line 124 and in turn connected to bottom flap 126 by fold line 128. End flaps 130 and 134 are connected to flap 112 by fold lines 132 and 136, respectively. Side end flaps 138 and 140 are similarly connected to inside side panel 114. Top end flaps 142 and 144 are connected to top panel 118. End flaps 146 and 148 are similarly connected to outside side panel 122. Bottom end flaps 150 and 152 are connected to bottom flap 126.

This carton also may have a dispenser 154 which can be removed after the carton has been filled with containers by tearing tear line 156. As in the case of carton B, the height of the bottom end flaps 134 and 152 and the portion of the side end flaps 140 and 148 remaining after removal of the dispenser 154 have a height (H) no greater than the diameter of the cans in the bottom row or tier. Side end flap 138 has a finger aperture 158. This carton also may have a handle 160 on the outside side panel 122 and a coupon 162 on the inside side panel 114 which can be removed by tearing tear line 164. Inside side panel 114 has cut lines 166 and 168 which line up respectively with cut lines 66 and 68 on carton B. The pattern of cut lines on inside side panel 14 and 114, respectively, are aligned when the two cartons are filled with cans, and the inside side panels are brought together.

Cartons A and B are formed by gluing respective flaps 12 and 26 and 112 and 126 together to form carton sleeves. The carton sleeves can then be filled with cans through an end in the usual manner.

After the A and B cartons have been filled, they are placed on a pallet and glue is applied by a glue gun or other means on lines 66 and 68 and the other cut lines on carton B. Carton A is then brought into juxtaposition with carton B so that cuts 66 and 166 and 68 and 168, respectively, are matched, along with the other cuts in each of the inside side panels 14 and 114. Cuts have been made completely through the paperboard to allow adequate glue penetration. After glue has been applied, the cartons need to be held in juxtaposition for a period of time for the glue to set up. A device can be built to facilitate putting the A and B cartons in proper position for the gluing and affixing one carton to the other. It has been found that gluing through these cuts can be achieved without adversely affecting the cans inside the cartons. Cuts are preferably made completely through the paperboard, but this may not always be necessary.

While other means of fastening the cartons together may be used, such as metal fasteners, glue is the preferred method.

Figure 2:
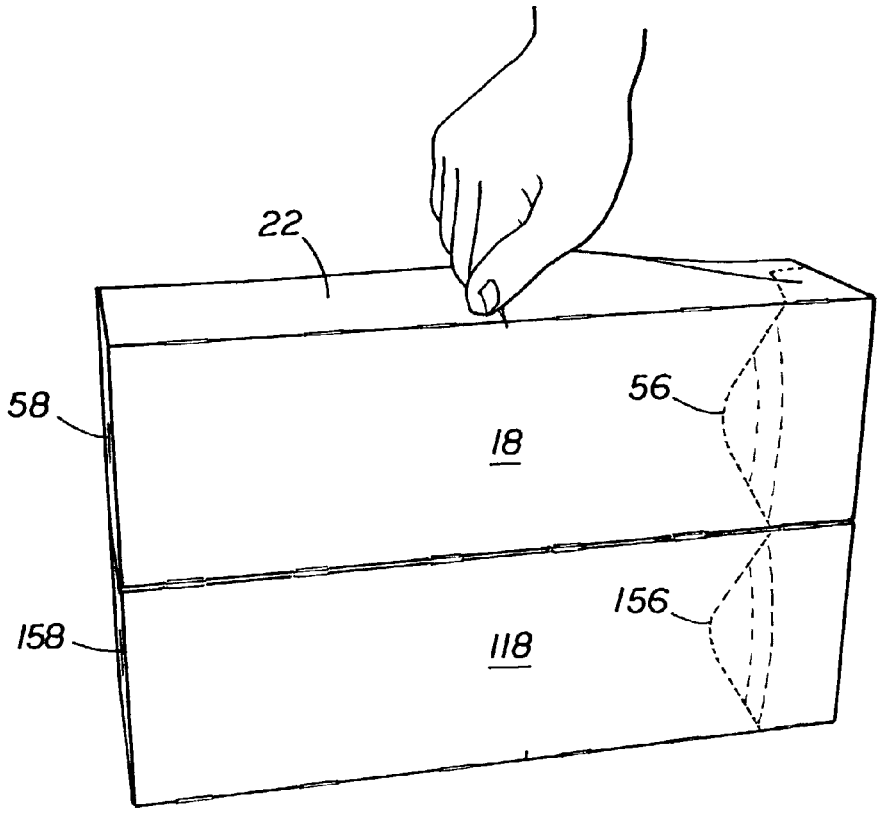
FIG. 2 is a side view of cartons A and B, filled with cans, that have been glued together.
Figure 3:
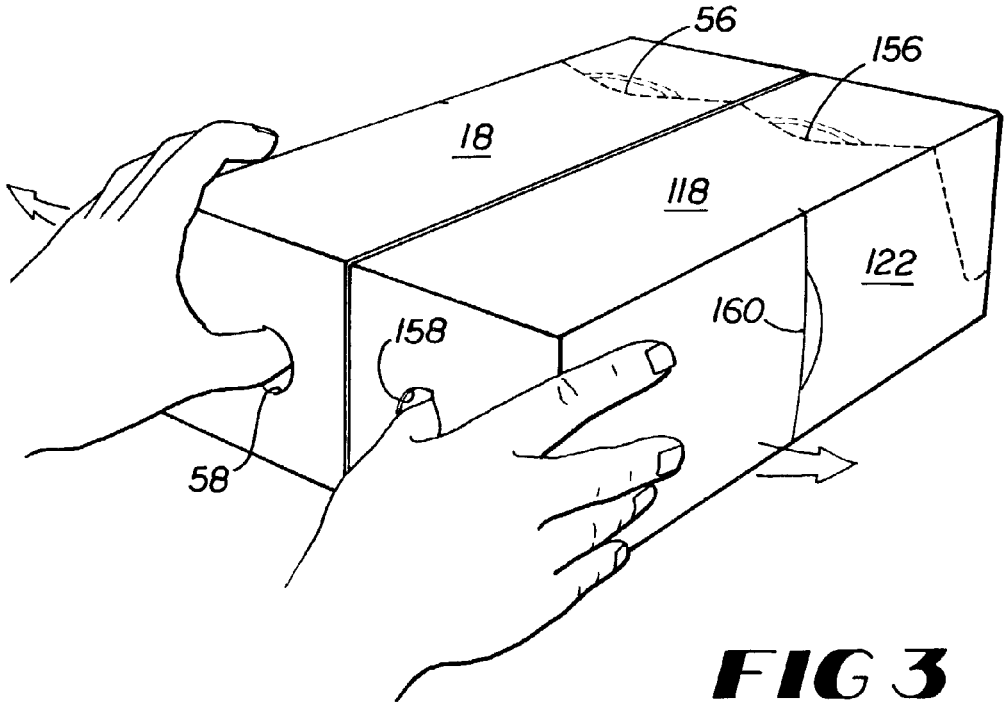
FIG. 3 is perspective end view showing a person about to separate cartons A and B.
Figure 4:
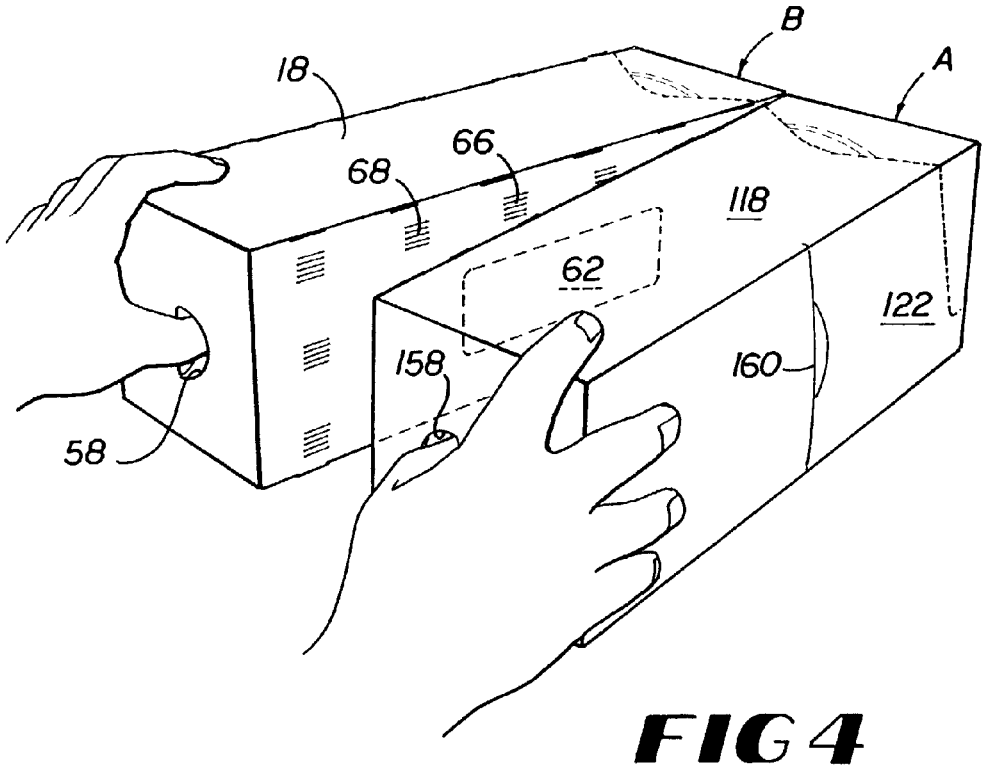
FIG. 4 is a perspective view of a person who is separating cartons A and B.
Figure 5:
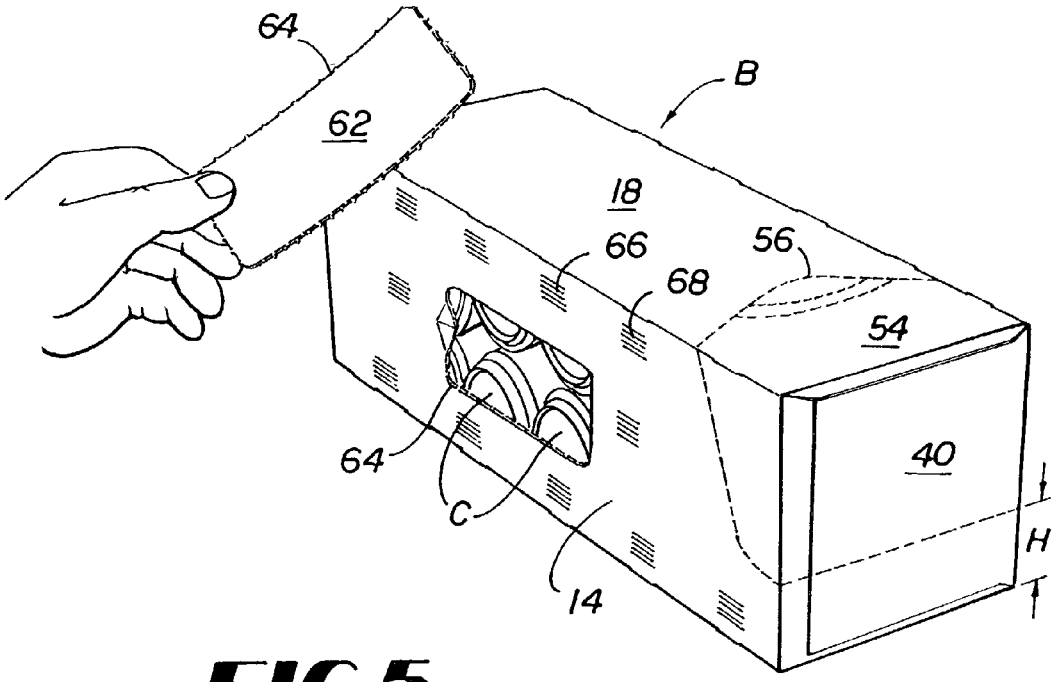
FIG. 5 is a perspective side view of an inside side wall of carton B from which a coupon has been removed from the panel.

Once the A and B cartons have been glued and the glue allowed to set up, the package can be picked up by the handle as illustrated in FIG. 2. The cartons of this invention are particularly designed to fit in refrigerators with the cans being dispensed from the dispensers. Sometimes, it will be desired to separate the A and B cartons, which can be done by inserting a thumb in finger apertures 58 and 158 and pulling the A and B cartons apart, as illustrated in FIGS. 3 and 4. This will allow the consumer to place the cartons in different places in the refrigerator or in different locations where the consumer desires.

After the cartons have been separated, the coupon 62 or 162 that has been attached to the inside side panel 14 or 114 can be removed by the consumer by tearing the tear line 64 or 164 that attaches the coupon to the inside side panel. The consumer cannot remove the coupon before purchasing the package and pulling the two cartons apart. This adds additional security for the coupons as the manufacturers prefer, so that a coupon cannot be removed from the carton in the store and used for another purpose other than intended. Various promotional items as desired can be placed between the two cartons as long as they do not interfere with the cut lines made or, the gluing of the cartons together.

Figure 6:
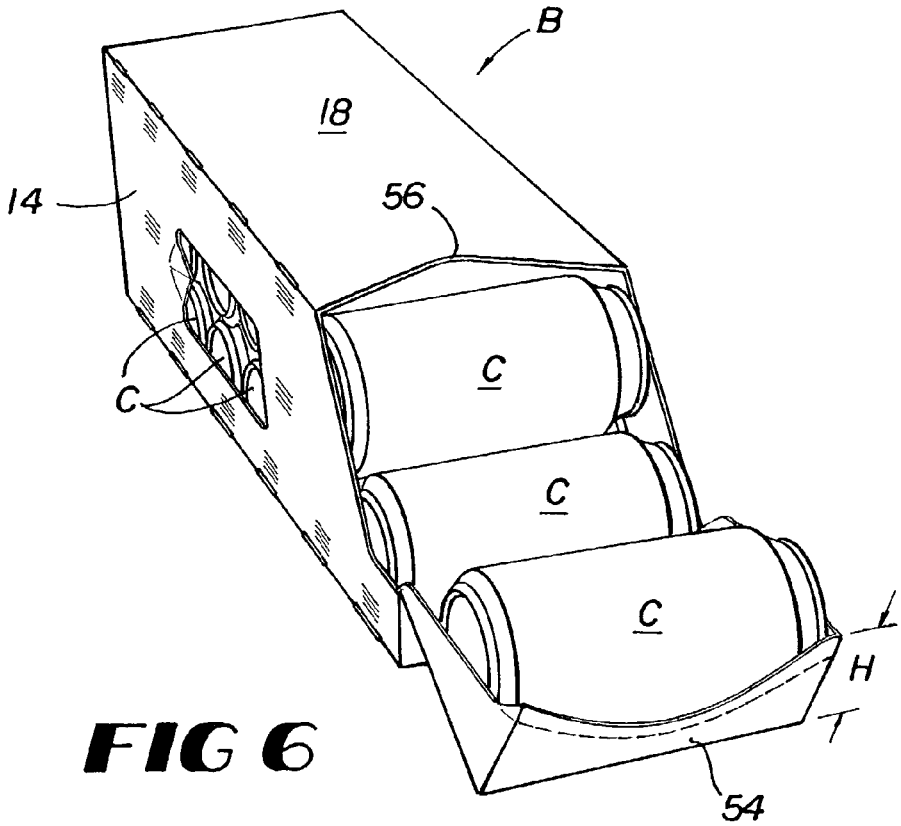
FIG. 6 is an end view of carton B with the carton dispenser opened with the dispenser still attached to the carton.
Figure 7:
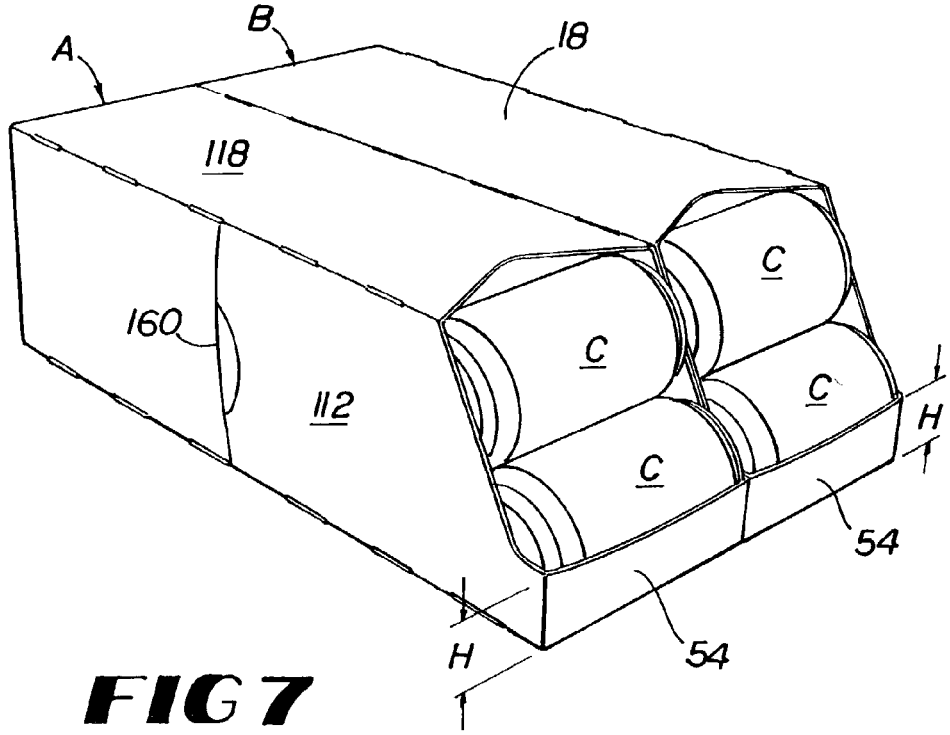
FIG. 7 is a perspective end view of cartons A and B joined together with the dispensers removed.

Opening the dispenser 54 will allow cans to be removed from carton B and is especially convenient for use in the refrigerator as illustrated in FIG. 6. Dispensers 54 and 154 can be removed from the carton as illustrated in FIG. 7 with the A and B cartons still glued together. An advantage of the dual pack is that different types of beverages can be placed in the cartons, giving the consumer a choice of which beverage he or she desires to consume.

Gluing of the A and B cartons together has been found to produce a satisfactory twin pack that can be carried by the handle once the glue has properly cured because of the cut lines that have been placed for the glue pattern to be applied to. It has been found that it is only necessary to apply the glue to the cut lines on one of the inside side panels. It is only necessary that the glue be applied to a limited extent to hold the cartons together. It has been found that the A and B cartons can be separated from each other without undue tearing of the paperboard, thus preserving the integrity of the inside side panels of both cartons. The inside side panels can be varnished on the portions where there are not cut lines, to facilitate separating the cartons.

It has been found that a handle can be constructed that is capable of carrying the combined cartons. The handle 60 can be a "racetrack" handle, or slotted handle on the outside side panel rather than the top panel, in a way in which the two cartons are affixed to each other. Other types of handles may be used as well.

It will be understood by those skilled in the art that the carton of the present invention is generally symmetrical about a horizontal line of bisection, as viewed when FIG. 1 is rotated lengthwise. This symmetry aids in the efficient production of the present carton.

Figure 12:
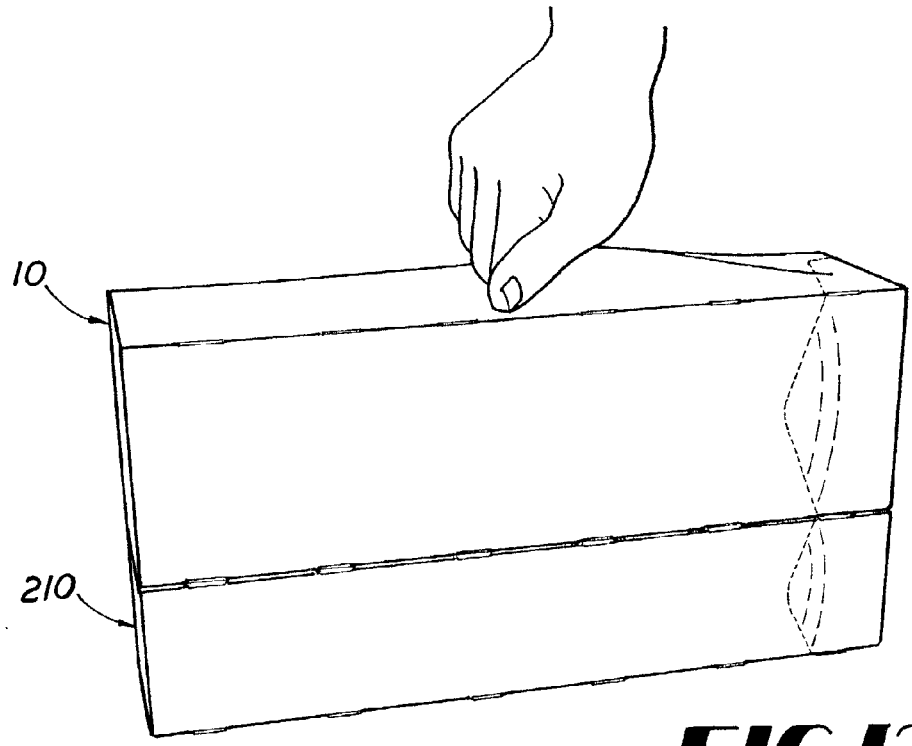
FIG. 12 is a perspective side view of a combination of two cartons, one containing 12 oz. cans and the other containing 8 oz. cans that have been joined together.

The twin pack is ideal for carrying cans for 8-oz. size as well as other sizes depending on the size and weight of the combined multipack. The twin pack, showing cartons containing 12 oz. cans is illustrated in FIG. 2, and another pack containing 8 oz. and 12 oz. cans, is illustrated in FIG. 12.

2. Triple Pack

Figure 8:
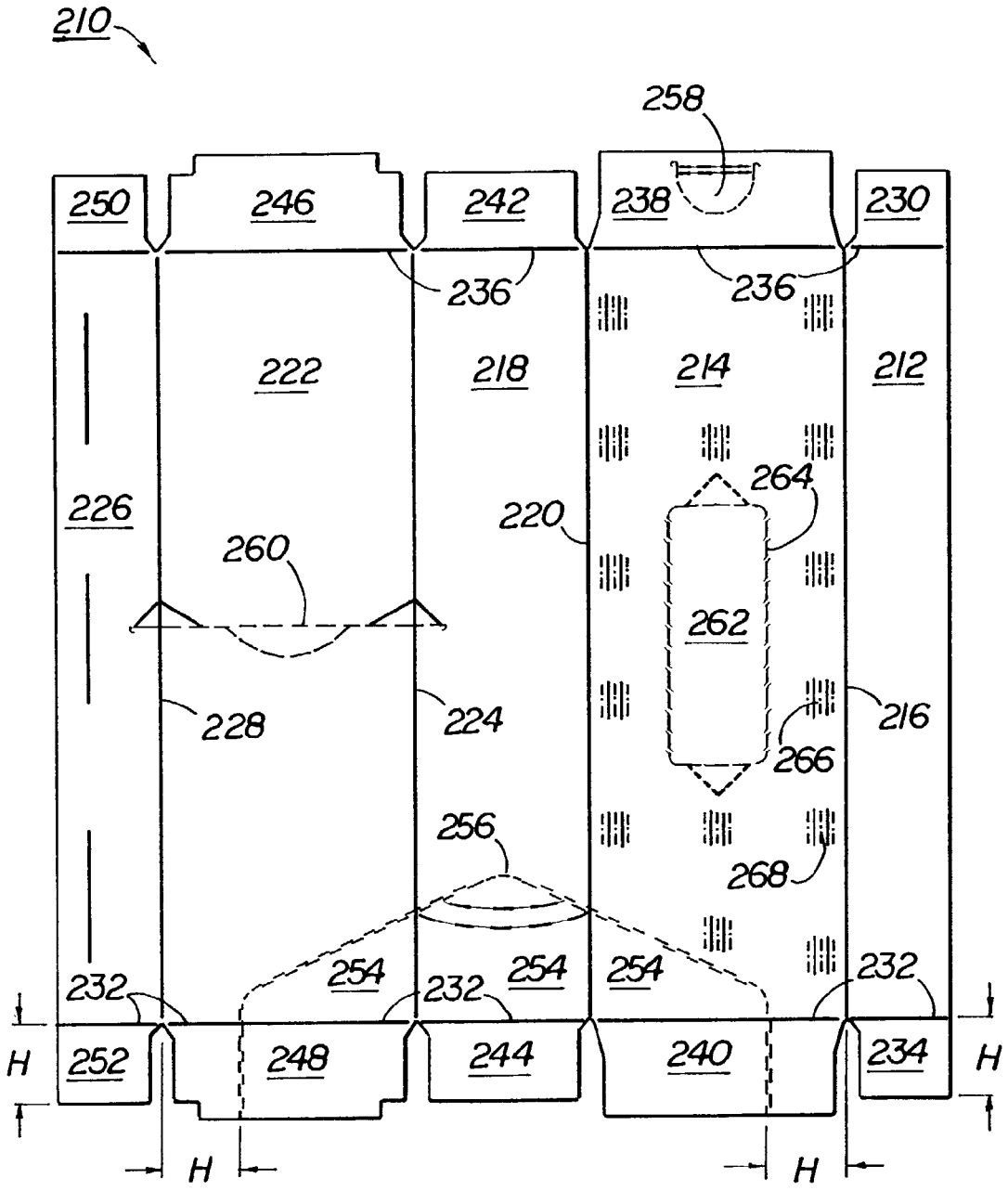
FIG. 8 is a plan view of a carton for 8 oz. cans designed to be the left-hand carton of a three-carton package viewed from the dispenser end.

Three or more cartons can be combined into a single package. Such a package is illustrated by FIGS. 8, 9, 10 and 11. FIG. 8 illustrates a blank 210 for a carton for the triple pack identified as a left hand carton as viewed from the dispensing end of the carton. The triple pack carton blank is similar to the blanks of the cartons illustrated in FIG. 1, and currently need not be explained in as much detail. The triple pack carton has a bottom flap 212, inside side panel 214, top panel 218, outside side panel 222, and bottom flap 226. It has bottom end flaps 230 and 234 and side end flaps 238 and 240. It has top end flaps 242 and 244, side end flaps 246 and 248, and bottom end flaps 250 and 252. This device is shown with dispenser 254 and tear line 256 for removing the dispenser. The carton likewise may have a handle 260 and coupon 262 with tear line 264 and a plurality of cut lines (e.g., 266 and 268) and finger aperture 258.

Figure 9:
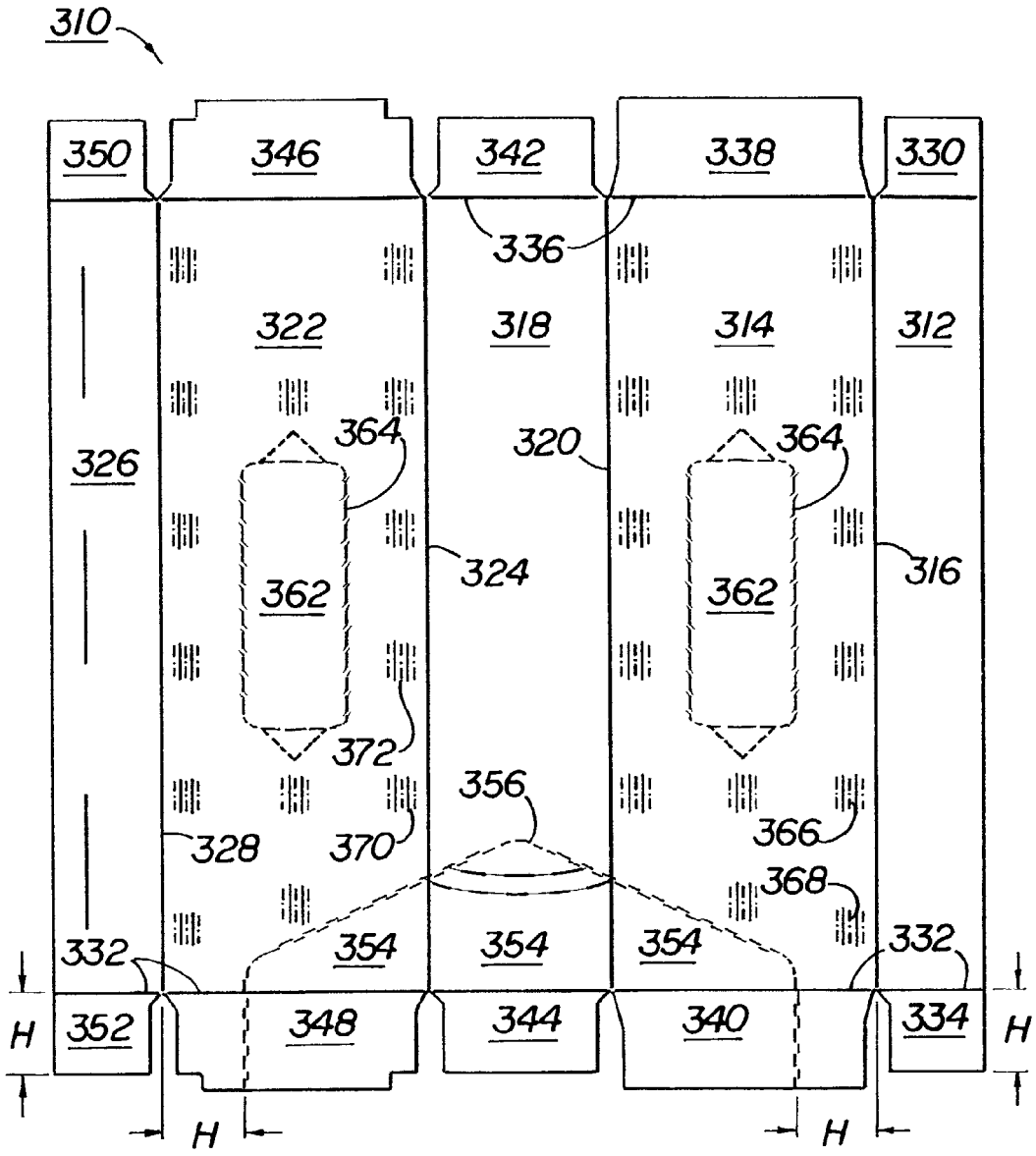
FIG. 9 is a plan view of the middle carton of a three-pack of 8 oz. cans.

The middle carton of this triple package is illustrated in FIG. 9, where the numeral 310 illustrates the blank. This carton has bottom flap 312, two inside side panels 314 and 322, separated by top panel 318. The carton has a bottom flap 326 and bottom end flaps 330 and 334, side end flaps 338 and 340, and top end flaps 342 and 344, side end flaps 346 and 348, and another set of bottom end flaps 350 and 352. This carton is also shown with a dispenser 354 that can be opened by tear line 356. A coupon 362 can be attached to part of each inside side panel 314 and 322. Each of the inside side panels has cut lines 366, 368, 370, and 372 designed to be aligned with corresponding cut lines on the right and left carton side panels.

Figure 10:
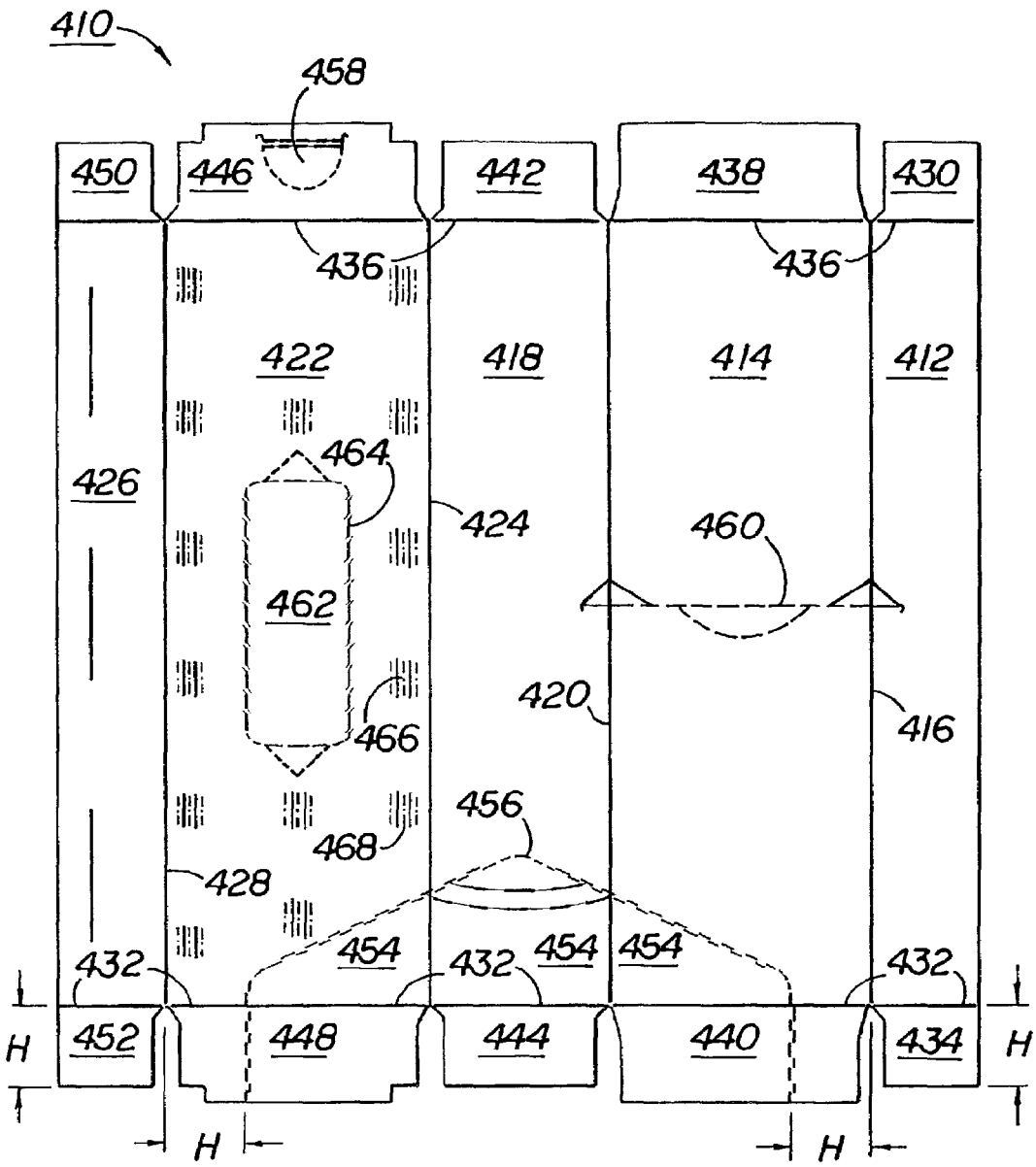
FIG. 10 is a plan view of the right hand carton as viewed from the dispenser end of a three-pack carton for containing 8 oz. cans.

The blank 410 for the right hand carton is illustrated in FIG. 10. It has a bottom flap 412 and inside side panel 422. It has a top panel 418 and outside side panel 414 and bottom flap 426, and it has bottom end flaps 430 and 434 and side end flaps 438 and 440 and top end flaps 442 and 444.

It has side end flaps 446 and 448 and bottom end flaps 450 and 452 and a dispenser 454 with tear line 456 and finger aperture 458. A coupon 462 may be attached to the inside side panel 422. It has cut lines 466 and 468 on inside side panel 422. As in the case of the twin packs, the height of the bottom end flaps 234, 252, 334, 352, 434 and 452 and portion of the side end flaps 240, 248, 340, 348, 440 and 448 after the removal of the dispenser on each of the cartons should preferably have a height (H) no greater than the diameter of the cans in the bottom row or tier.

Figure 11:
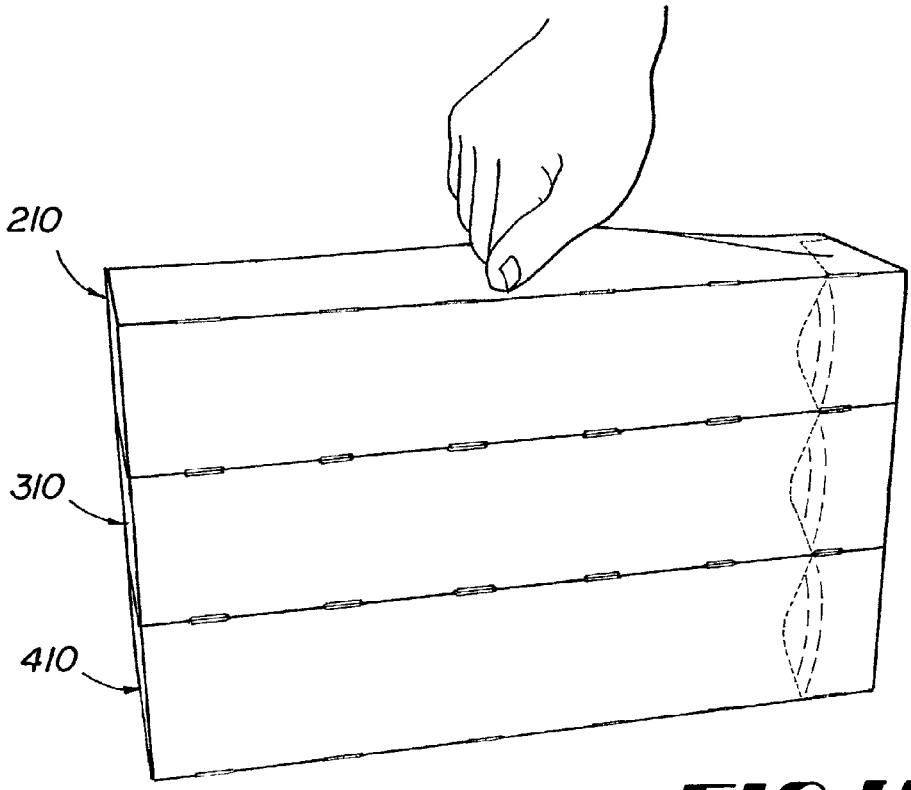
FIG. 11 is a side perspective view of three cartons of 8 oz. cans that have been joined together to form a single package.

The bottom flaps on these three cartons are glued in a conventional manner to produce the sleeves, which are then filled with cans or bottles, with the end flaps being sealed. The packages are put together to form a triple pack by applying glue to the cut lines on panel 322 of cartons formed from the blank shown in FIG. 9. Glue is placed on the cut lines on inside side panel 422 of the right hand carton are illustrated in FIG. 10. These three cartons, filled with containers, are then put together so that the cut lines on inside panel 422 match with the cut lines on inside panel 314 and cut lines on inside panel 322 of middle carton match the cut lines on inside panel 214 of the left hand carton. Thus, cut lines 266 and 268 match cut lines 372 and 370 respectively and cut lines 366 and 368 match cut lines 466 and 468, respectively. Glue is preferably only applied to the cut lines on one of the adjoining panels. The resulting triple pack is shown in FIG. 11. It is designed for carrying 8-oz containers. The package can be used as a shipping package from the beverage manufacturer to the store and separated in the store, or may be sold as the triple pack and left together or separated by the consumer, or can be divided as in the twin pack, separating the three cartons from each other. The dispenser may be left out of the shipping package.

Unique Features of the Dispenser of this Application

The unique feature of the dispenser of each carton of this invention is that it provides easy access to the cans or bottles in the carton, yet does not significantly diminish the structural integrity of the carton. This is partly because the bottom end of the end panel in which the dispenser is located is retained. This is accomplished by leaving a bottom portion on the side end panels that is equal in height to the bottom end flaps and no greater than the diameter of the cans or bottles in the bottom row or tier.

The dispenser of this invention can be easily opened by the provision of tear lines.

This dispenser also provides a safety net or basket in that if the tear line for the dispenser is not torn along the side end flaps, it remains attached to the carton and can catch a can in its basket as it is removed from the carton.

The multiple carton packs inventions are unique and can be glued together to produce secure packages, but yet can be easily torn apart and separated into separate cartons. This is accomplished by the unique feature of providing a pattern of cut lines, that can be glued together, and only applying glue to the cut lines on one panel and affixing it to an adjoining panel. It is surprising that a multicarton package with a high degree of structural integrity could be produced in this way, but yet easily separated by the consumer, without destroying the side panels. It should be realized that such gluing could be used to glue cartons together to form shipping packages with or without a dispenser, and broader applications where it is necessary to glue two pieces of paperboard together but yet permit their easy separation.

While this invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. A package comprising:

a plurality of enclosed cartons, each carton held together by glue and each carton comprising a bottom panel, top panel and foldably attached adjoining side panels and each carton having two ends, at least one of which is an exiting end capable of permitting containers to exit the carton one at a time;

said exiting end of each carton having a bottom end flap with a height and which is attached by a fold line to the bottom panel, a top end flap foldably attached to the top panel, a side end flap foldably attached to each side panel, and means for attaching said flaps together to close the exiting end of the carton;

a plurality of generally cylindrical containers positioned in each carton such that the longitudinal axis of each generally cylindrical container is substantially parallel to said top panel and said bottom panel;

a tear line for forming a container dispenser opening, said tear line extending through the top panel at a distance spaced from the exiting end and extending through each side panel toward the exiting end to the attachment of said side panel with a side end flap, a fold line extending through each side end flap at a distance from the bottom panel approximately equal to, or less than, the height of the bottom end flap;

so that when the tear line is torn, a dispenser is formed for dispensing the containers, with the dispenser remaining attached to the carton by the fold line through each side end flap, so that the bottom end flap and a portion of each side end flap adjacent to the bottom end flap remain attached to the carton to provide structural integrity to the carton, said dispenser forming a basket for catching containers exiting the carton;

means for closing the end of the carton that is not an exiting end; and at least one side panel in each carton being attached to a side panel in an adjoining carton to form an integrated package, and a side panel of at least one carton having a plurality of cut lines and the carton having such cut lines being joined to the adjoining carton by glue contacting both the cut lines and the adjoining carton.

2. The package of claim 1, in which the amount of glue present at the cut lines is sufficient to hold the cartons together when the package is lifted but allows adjoining cartons to be easily separated without destroying the integrity of the adjoining cartons.

3. The package of claim 1, in which a side panel that is not an adjoining panel has a handle for carrying the package.

4. The package of claim 2, in which each carton has a finger aperture in exiting end to facilitate separating the cartons.

5. A package consisting of a plurality of enclosed cartons, each carton for carrying a plurality of containers, each carton having two ends, at least one of which is an exiting end capable of permitting containers to exit the carton one at a time, each carton comprising:

a bottom panel, top panel and foldably attached adjoining side panels a plurality of cut lines on at least one panel of said a bottom panel, top panel or foldably attached adjoining side panels;

said exiting end having a bottom end flap with a height and which is attached by a fold line to the bottom panel, a top end flap foldably attached to the top panel, a side end flap foldably attached to each side panel, and means for attaching said flaps together to close the exiting end of the carton;

said exiting end having a tear line for forming a container dispenser opening, said tear line extending through the top panel at a distance spaced from the exiting end and extending at an angle through each side panel towards the exiting end to the attachment of said side panel with a side end flap at a distance greater from the top panel than the bottom panel, with a fold line extending through each side end flap at a distance from the bottom panel approximately equal to the height of the bottom end flap, so that when the tear line is torn, a dispenser opening is formed for dispensing the containers, with the dispenser remaining attached to the carton by the fold line through each side end flap, so that the bottom end flap and a portion of each side end flap adjacent to the bottom end flap remain attached to the carton to provide structural integrity to the carton, said dispenser forming a basket for catching containers exiting the carton;

means for closing the end of the carton that is not an exiting end; and each carton being attached to at least one adjoining carton by an adhesive positioned on at least one cut line of the plurality of cut lines, thereby forming an integrated package.

6. The package of claim 5, in which glue is applied to at least one cut line on only one panel of the adjoining panels so that adjoining cartons can be easily separated without destroying the integrity of the adjoining panels.

7. The package of claim 6, in which each carton has a finger aperture in exiting end to facilitate separating the cartons.

8. The package of claim 5, in which the adjoining panels that are attached are side panels.

9. The package of claim 5, in which a side panel that is not an adjoining panel has a handle for carrying the package.

* * * * *